United States Patent [19]

Leong

[11] 4,298,104

[45] Nov. 3, 1981

[54] LUGGAGE HANDLE HAVING RELEASABLE LOCKING ASSEMBLY

[76] Inventor: Henry Leong, 6 Waller Ct., Kendall Park, N.J. 08824

[21] Appl. No.: 104,356

[22] Filed: Dec. 17, 1979

[51] Int. Cl.[3] ..... A45C 13/26

[52] U.S. Cl. ..... 190/48; 150/3; 150/12; 190/55 R

[58] Field of Search ..... 190/48, 55 R, 41 Z; 150/3, 12; 229/54 R

[56] References Cited

U.S. PATENT DOCUMENTS

| | | | |
|---|---|---|---|
| 1,571,475 | 2/1926 | Guenther | 190/48 X |
| 2,319,127 | 5/1943 | Guenther et al. | 190/55 X |
| 3,302,860 | 2/1967 | Schwarzkopf | 229/54 R |
| 3,333,308 | 8/1967 | Mack | 150/12 X |
| 3,528,471 | 9/1970 | Hartmann | 150/3 |
| 3,558,038 | 1/1971 | Gelles | 150/12 |

*Primary Examiner*—Donald F. Norton
*Attorney, Agent, or Firm*—Weinstein & Sutton

[57] ABSTRACT

A carrying handle assembly for luggage, parcels and the like comprised of first and second handle halves arranged to be releasably joined with one another and contoured to facilitate gripping and carrying without causing discomfort to the hand. Each handle half is comprised of a cooperating mating element consisting of a contoured outer handle part and an inner locking part, the inner and outer parts being positioned on opposite sides of an upwardly extending flap integral with one of the major side surfaces of the luggage and adapted to be sandwiched between the aforesaid inner and outer parts. Interfitting male/female type joining members secure the inner and outer parts of each handle half to one another.

The inner handle parts of each handle half are respectively provided with cooperating openings and projections adapted to be interfitted and releasably secured to one another to facilitate both closure and carrying of the luggage piece.

15 Claims, 19 Drawing Figures

LUGGAGE HANDLE HAVING RELEASABLE LOCKING ASSEMBLY

BACKGROUND OF THE INVENTION

The present invention relates generally to luggage handles and more particularly to an inexpensive molded handle assembly comprised of handle halves which are adapted to be releasably secured by novel locking means to provide a combination bag or luggage locking and carrying assembly.

Conventional luggage typically employs either one or two pivotally mounted handles each of which are swingably secured to adjacent sidewalls of the luggage piece by pivot links provided on the sidewalls of the luggage piece.

The disadvantages of such mountings reside in the fact that the first link must be securely joined to the sidewalls of the luggage and must be of sufficient strength to prevent breakage due to the rough handling typically encountered in the normal use of the luggage.

BRIEF DESCRIPTION OF THE INVENTION

It is therefore one object of the invention to provide a novel handle assembly for luggage, carrying bags and the like, which overcomes the disadvantages of the prior art.

Still another object of the present invention is to provide a new and improved handle assembly comprised of handle halves integrally joined to the upper flaps of the luggage piece to eliminate the need for conventional pivotable linkage assemblies.

Still another object of the present invention is to provide a new and improved handle assembly utilizing molded handle elements having novel releasable locking means and which are inexpensive to manufacture.

The above as well as other objects of the invention are achieved by providing a luggage handle assembly comprised of first and second cooperating handle halves, each handle half, in turn, being comprised of inner and outer handle portions. The exterior gripping surfaces of the outer handle portions are smoothly contoured to provide a pair of cooperating hand grips which are devoid of sharp edges or corners which might otherwise tend to cut into the hand of or otherwise cause discomfort to the person carrying the luggage piece. The inner and outer portions of each handle half are integrally joined to a pliant and relatively soft upper flap forming an integral part of each major side surface of the luggage piece, which flaps provide functions equivalent to those normally attributed to conventional pivotable hinge assemblies. The said flaps extend over the entire length of the major side surfaces and further act to distribute the forces exerted by the handle and the luggage upon one another over a significantly large area thus substantially eliminating any localized stress upon the handle assembly and further distributing the load in a balanced manner.

The inner and outer portions of each handle half are positioned along opposite surfaces of their associated flap and are joined together by suitable fastening means which may take the form of conventional threaded fasteners. Alternatively, the inner and outer portions may be provided with cooperating projections and projection receiving apertures adapted to be interfitted with one another. The flap is sandwiched therebetween whereby the inner and outer handle portions are firmly secured to one another as well as being firmly secured to their associated flap.

The inner portions of each handle half are provided with cooperating projections and projection receiving openings which serve to positively maintain the handle halves in perfect registry and in the locked position when the handle halves are joined together.

Said projection receiving openings are provided with a recess which cooperates with a locking projection associated with each registry projection which locking projection is arranged to be snapfittingly received within said recess to retain the handle halves in the interfitted position. The physical configuration of the handle halves and the forces exerted upon the handle halves due to the weight of the luggage piece acting upon the handle halves when the luggage piece is being carried, serve to retain the handle halves in the locked position.

When it is desired to open the luggage piece, the handle halves may be separated simply by setting the luggage piece upon a surface; removing the hand gripping the handle halves from the handle assembly and separating the handle halves by exerting only a light separating force.

The inner and outer handle portions of each handle half may be inexpensively fabricated preferably by a molding operation so that their exterior appearance blends in with the overall design of the luggage piece to provide an aesthetically appealing assembly as well as a utilitarian handle design.

BRIEF DESCRIPTION OF THE FIGURES

The above as well as other objects of the present invention will become apparent when reading the accompanying description and drawings in which.

DETAILED DESCRIPTION OF THE INVENTION

Figure 1:
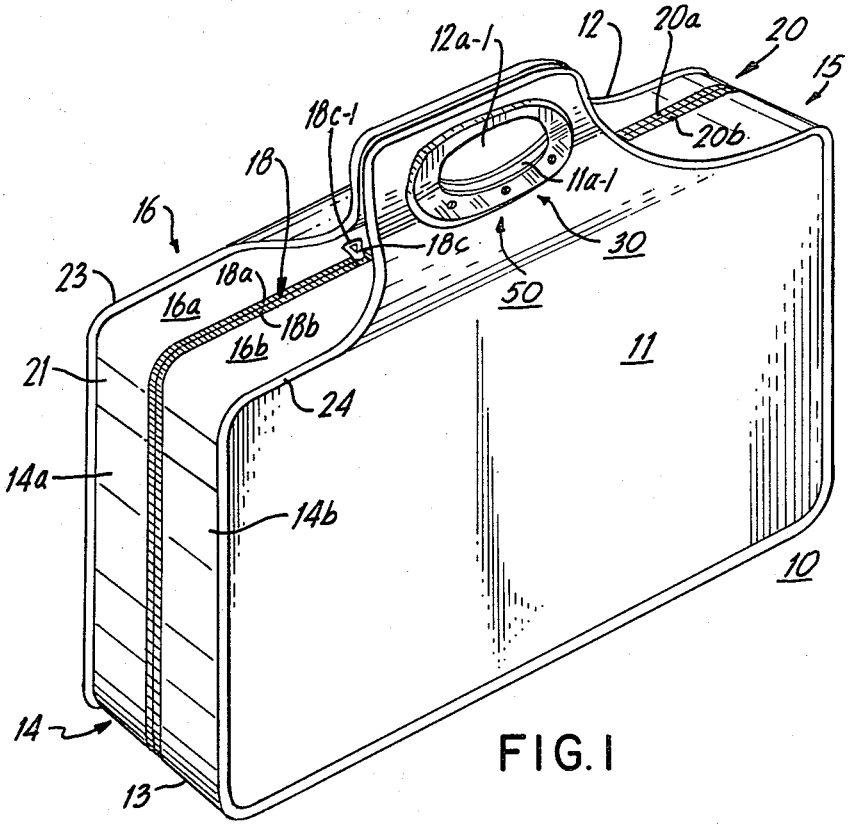
FIG. 1 shows a perspective view of a luggage piece incorporating the handle assembly of the present invention.
Figure 2:
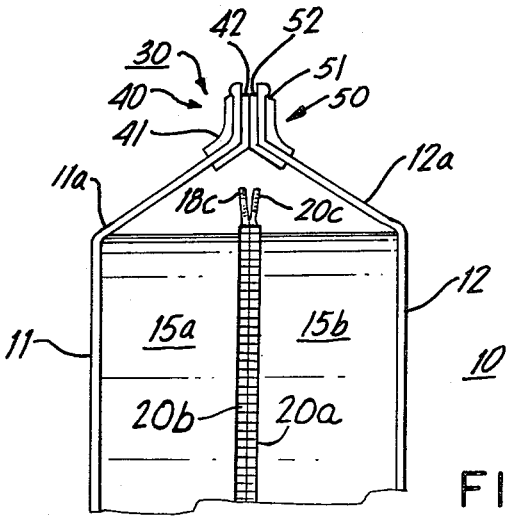
FIG. 2 shows a partial end view of the luggage piece of FIG. 1 showing the handle halves being joined in the carrying position.

FIGS. 1 and 2 show a luggage piece 10 comprised of sidewalls 11 and 12, bottom surface 13, end walls 14 and 15 and top surface 16. Top surface 16 is in reality comprised of first and second top surface halves 16*a* and 16*b* which are releasably joined by closure of the first and second slide fastener assemblies 18 and 20. Each slide fastener is comprised of a pair of conventional rows of teeth 18*a*, 18*b* and 20*a*, 20*b* which are selectively interfitted or released from one another by means of slide members 18*c* and 20*c* (note also FIG. 2). The slide member 20*c* for slide fastener assembly 20 is substantially identical to the slide member 18*c*. Preferably, both slide fastener assemblies 18 and 20 are arranged to have their lower ends (not shown) extended at least partially into bottom surface 13. Although not shown, the portion of bottom surface 13 extending between the lower terminations of slide fastener assemblies of 18 and 20 may be provided with suitable hinge means to enable the luggage piece to be swung open to the fullest extent to gain access to items contained therein. Alternatively, if the luggage piece is made of a pliant material, such hinge means may be eliminated altogether.

The upper terminating ends of slide fastener assemblies 18 and 20 preferably extend to the central portion of luggage top surface 16 to substantially completely close the luggage piece 10. The slide fastener such as, for example, slide fastener 18*c*, is provided with a central opening 18*c*-1. Slide member 20*c* is provided with a similar opening. When the slide members 18*c*, 20*c* are moved to their upper termination points of their associated slide fastener assemblies along top surface 16 and brought into alignment with one another in the manner shown in FIG. 2, the shackle (not shown) of a small lock may be inserted therethrough to prevent unauthorized persons from gaining access to the interior of the luggage.

Side surfaces 14 and 15 also consist of surface halves 14*a*–14*b* and 15*a*–15*b* which are integrally joined to the top and bottom surfaces 13 and 16, each jointure being located at a curved convex corner such as, for example, the corner 21.

Both halves 16*a*, 16*b*, 14*a*, 14*b*, 15*a* and 15*c* of the surfaces 16, 14 and 15, as well as bottom surface 13, are joined to the major side surfaces 11 and 12, said mechanical jointure, in one preferred embodiment being established along a sewn seam finished for styling purposes with an aesthetically appealing piping such as the pipings 23 and 24.

The side surfaces 11 and 12 each further include an upwardly extending integral flap 11*a* and 12*a*. The surfaces of luggage piece 10 are formed of a pliant supple material such as leather or a durable pliant cloth material which is capable of bending and being moved very easily to either the opened or closed position.

Each flap 11*a* and 12*a* is provided with an opening 11*a*-1 and 12*a*-1 which openings may be brought in close proximity to one another to facilitate the insertion of one's fingers through said openings for gripping and lifting the luggage piece 10.

Figure 3A:
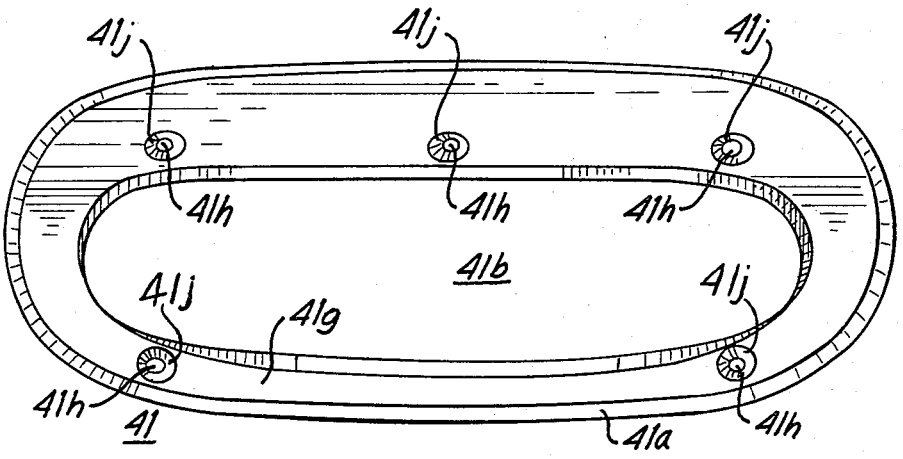
FIG. 3*a* shows a plan view of the outer handle portion of FIG. 3*c* looking in the direction of arrows 3*a*—3*a*.
Figure 3B:
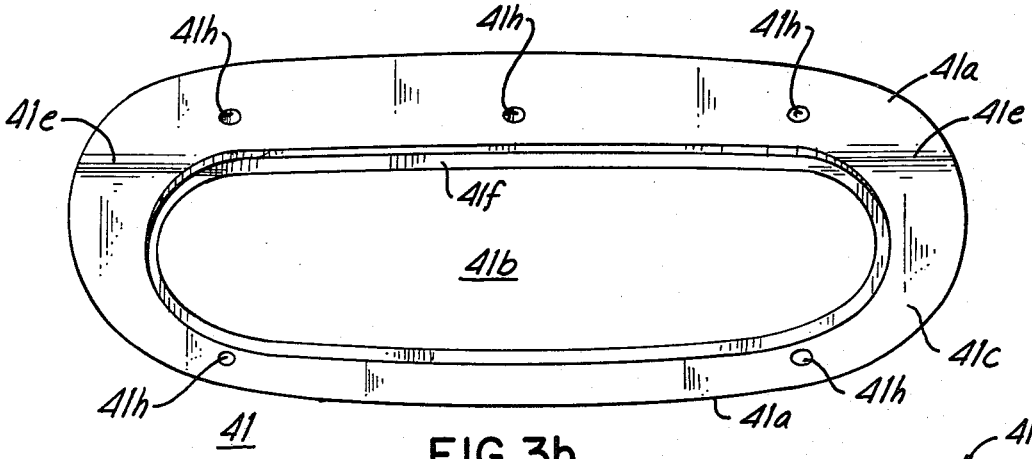
FIG. 3*b* shows a plan view of the outer handle portion of FIG. 3*c* looking in the direction of arrows 3*b*—3*b*.

Each flap 11*a*, 12*a* supports an integrally joined handle half 40 and 50 of handle assembly 30 (FIGS. 1 and 2), handle half 40 being comprised of outer and inner handle portions 41 and 42 and handle half 50 being comprised of outer and inner handle halves 51 and 52. FIG. 2 shows the arrangement of the handle halves when fully assembled for carrying purposes. The outer handle portions 41 and 51 of each handle half 40 and 50 are substantially identical to one another and hence only one of said handle halves will be described herein in detail for purposes of brevity. FIGS. 3*a*–3*c* show outer handle portion 41 which is a unitary one-piece member having a substantially oval-shaped outer periphery 41*a* and a substantially centrally located oval-shaped central opening 41*b*. The rearward side of outer handle portion 41 is comprised of substantially flat surface portions 41*c* and 41*d* joined along an edge 41*e* and forming an obtuse angle whose vertex coincides with edge 41*e*.

An outwardly directed continuous lip 41*f* is integral with the main body of handle portion 41 and encircles the marginal portion of central opening 41*b*. The exterior surface 41*g* of outer handle portion 41 has a smooth surface curvature which is substantially convex to provide an aesthetically appealing outer surface as well as a surface which is smooth to prevent any discomfort to the person carrying the luggage piece by means of the handle assembly 30. The surface curvature of the upper and lower ends of outer handle portion 41 is shown by designating numeral 41*g*-1 and 41*g*-2 in FIG. 3*c*.

Outer handle part 41, in the embodiment shown in FIGS. 3*a*–3*c*, is provided with a plurality of openings 41*h* each being adapted to receive a threaded fastening member (not shown). Each of the openings 41*h* has a countersunk periphery 41*j* in order to allow the aforesaid threaded fastening member (not shown) to be inserted into the opening so that the top surface (not shown) is flush with the surface of 41*g*-1 or 41*g*-2 of the outer handle portion 41.

Figure 3E:
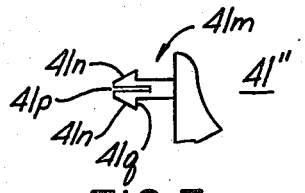
FIG. 3*e* is an end view of an alternative embodiment of the mounting projections of FIG. 3*d*.
Figure 3C:
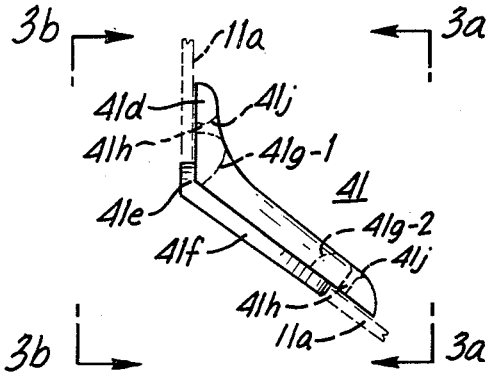
FIG. 3*c* shows an end elevational view of one outer handle portion of the handle halves shown in FIGS. 1 and 2, both outer handle portions being substantially identical.
Figure 3D:
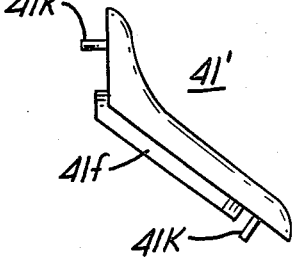
FIG. 3*d* shows an end elevational view of an alternative embodiment for the outer handle portion of FIG. 3*c*.

FIG. 3*d* shows an alternative embodiment 41' for the outer handle portion wherein the openings 41*h* of FIGS. 3*a*–3*c* are replaced by integral projecting pins 41*k* arranged at substantially the same locations as openings 41*h* and adapted to be inserted into cooperating openings in the associated inner handle portion (to be more fully described), said inner and outer handle portions being secured to one another preferably by an ultra-sonic bonding technique.

As was previously described, each flap 11*a* and 12*a* (FIGS. 1 and 2) is provided with an opening having a shape such that the inner periphery of the opening of the flap is arranged to surround the outer periphery of lip 41*f* in the manner shown in dotted line fashion in FIG. 3*c*. The flap 11*a* is also preferably provided with openings (not shown) which are arranged in alignment with the openings 41*h* in order to facilitate insertion of the threaded fastening members. In the alternative embodiment 41' of FIG. 3*d*, the openings provided in said flap are designed to receive the projecting pins 41*k*.

Figure 4A:
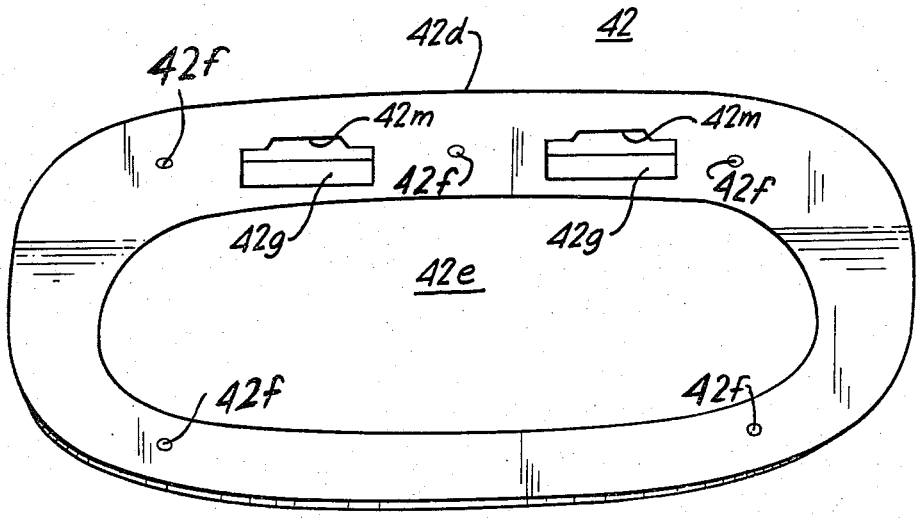
FIG. 4*a* shows a plan view of the inner handle portion of FIG. 4*c* looking in the direction of arrows 4*a*—4*a*.
Figure 4B:
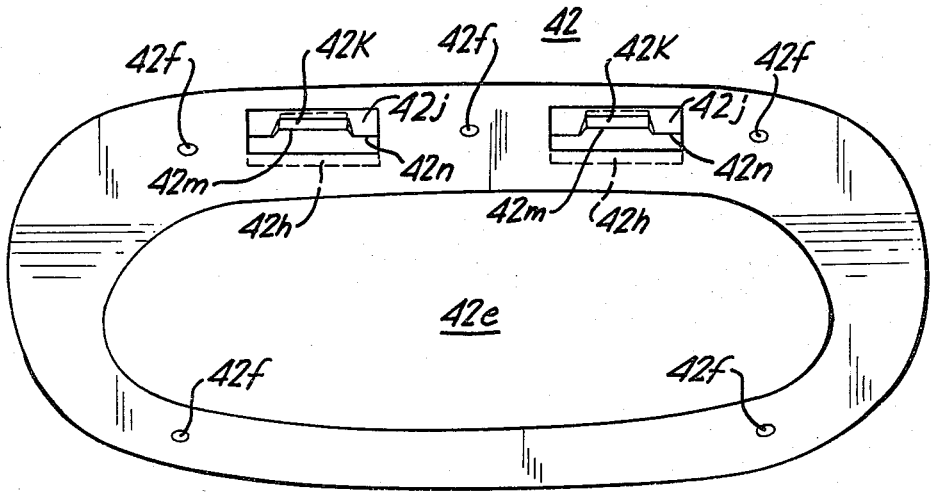
FIG. 4*b* shows a plan view of the inner handle portion of FIG. 4*c* looking in the direction of 4*b*—4*b*.

FIG. 3*e* shows an alternative arrangement of the outer handle portion 41'' which is provided with integral pins 41*m*, only one pin being shown for purposes of simplicity. Pin 41*m* has a tapered end 41*n* which is wider in diameter than the main body of pin 41*m* to form a shoulder 41*g*. The end portion has radially aligned slots 41*p* (only one being shown in FIG. 3*e*) allowing the tapered portion to collapse to allow the tapered portion to be inserted into a hole 42*f* in member 42 (see FIG. 4*b*). When the tapered end clears opening 42*f*, it expands whereupon shoulder 41*g* locks against the surface of member 42 surrounding hole 42*f*.

Figure 4C:
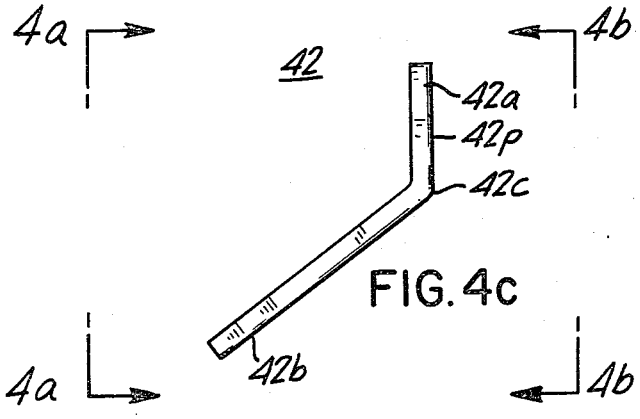
FIG. 4*c* shows a side elevational view of one of the inner handle halves of the handle assembly of FIGS. 1 and 2.

As can best be seen from a consideration of FIG. 2, each outer handle portion 41 and 51 is adapted to be secured to an inner handle portion 42 and 52 with the flaps 11*a* and 12*a* being sandwiched therebetween. The inner handle portion 42 as shown in detail in FIGS. 4*a*–4*c* and the inner handle portion 52 is shown in detail in FIGS. 5*a*–5*c*. Considering initially inner handle portion 42, from a consideration of FIGS. 4*a*–4*c*, it can be seen that the handle portion 42 is comprised of a unitary one-piece member preferably molded or otherwise formed from a suitable semi-rigid plastic material such as, for example, nylon, polypropylene, polycarbonate and acrylonitrile-butadiene-styrene copolymers commonly referred to as ABS copolymers.

Member 42 is a substantially V-shaped member comprised of first and second flat portions 42*a* and 42*b* integrally joined along a bend or vertex 42*c* forming an obtuse angle which is substantially equal to the obtuse angle formed by the flat surfaces 41*c* and 41*d* of outer handle portion 41. The outer periphery 42*d* of member 42 is substantially oval and generally conforms to the oval shape of the periphery 41*a* of outer handle portion 41 shown, for example, in FIG. 3*a*. Member 42 is provided with a substantially centrally located oval-shaped opening 42*e* which is adapted to be aligned with the central opening 50*b* of outer handle portion 50 and with the opening (not shown) in flap 11*a*. Lip 41*f* shown best in FIG. 3*a*, is adapted to be inserted into the opening 42*e* so that its outer periphery rests against the periphery of opening 42*e*.

Portions 42*a* and 42*b* of member 42 are provided with openings 42*f* for receiving threaded fastening members when used with the outer handle portion 41 of FIG. 3*c* and alternatively are adapted to receive the projecting pins 41*k* in the alternative embodiment 41' of FIG. 3*d*. As was previously mentioned, pins 41*k* are in alignment with each of the openings 42*f* and with openings (not shown) provided in the associated flap 11*a* to facilitate the assembly of the inner and outer handle portions 41 and 42 upon flap 11*a*. In the case of the embodiment 41' of FIG. 3*d*, after the inner and outer handle portions 41' and 42 are mounted upon flap 11*a* and with flap 11*a* sandwiched therebetween, ultra-sonic bonding means are utilized to heat the projecting pins to a level sufficient to cause the projecting pins 41*k* and the body portion of member 42 surrounding each of the openings 42*f* to soften to a degree sufficient to cause the pins 41*k* and member 42 to be fused together and thereby provide an excellent bond therebetween. The flap 11*a* is maintained firmly sandwiched between inner and outer handle portions 41 and 42 by virtue of the aforesaid bond.

Inner handle portion 42 is further provided with a pair of substantially rectangular-shaped slots 42*g*. The lower edge of each slot 42*g* is provided with a sloping or diagonally-inclined surface 42*h*, shown best in FIGS. 4*b* and 6*a*. The upper edge portion of each slot 42*g* is provided with a diagonally-inclined or sloping surface 42*j* which is arranged substantially parallel to sloping surface 42*h*. Each sloping surface 42*j* is provided with a centrally-located, diagonally-aligned recess 42*k*, whose upper edge forms a shoulder 42*m* communicating with the surface of recess 42*k* and the sloping surface 42*j*, as shown best in FIG. 6*a*. The lower edge 42*m* of each recess 42*k*, is located above the lower edge 42*n* of upper sloping surface 42*j*.

Member 42 has a shape which substantially conforms to member 41, as can best be seen in FIG. 2, so as to sandwich flap 11*a* therebetween and cause members 41 and 42 and flap 11*a* to be snugly interfitted in the manner previously described. The manner in which the inner handle part 42 is interfitted with outer handle part 41 and flap 11*a* is such as to enable the exterior surface 42*p* (FIG. 4*c*) to engage the exterior surface 52*t* of inner handle portion 52 forming part of handle half 50, as shown best in FIGS. 2 and 6*a*–6*c*, for example.

As was mentioned hereinabove, outer handle portion 51 of handle half 50 is substantially identical in design and function to outer handle portion 41 of handle half 40 and a further description of outer handle portion 51 will be omitted herein for purposes of brevity.

Figure 5A:
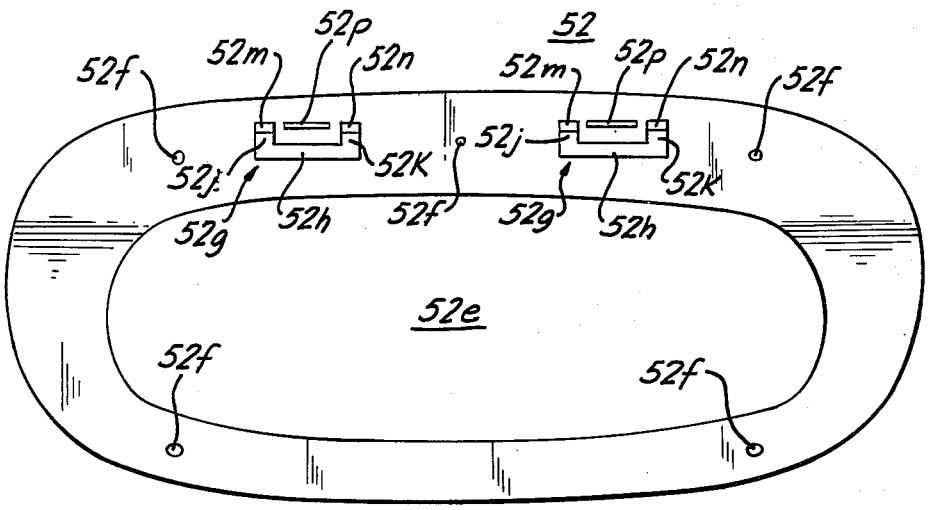
FIG. 5*a* shows a plan view of the inner handle portion of FIG. 5*c* looking in the direction of arrows 5*a*—5*a*.
Figure 5B:
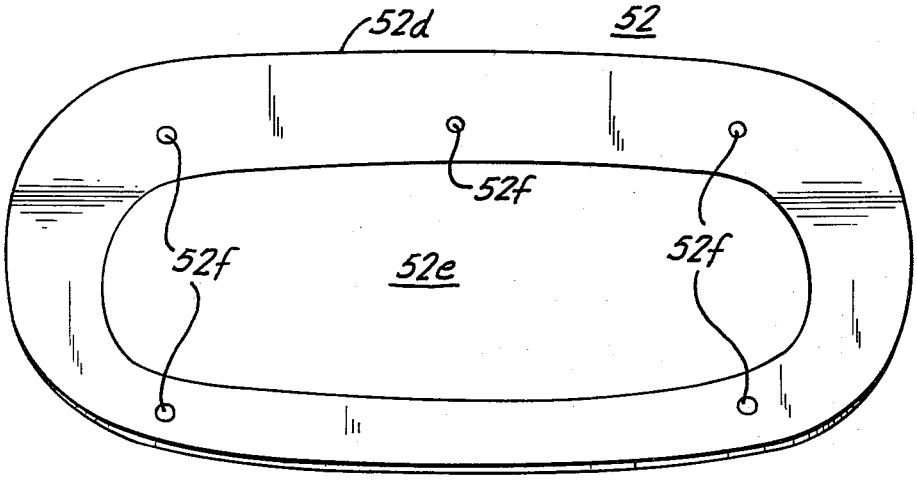
FIG. 5*b* shows a plan view of the inner handle portion of FIG. 5*c* looking in the direction of arrows 5*b*—5*b*.
Figure 5C:
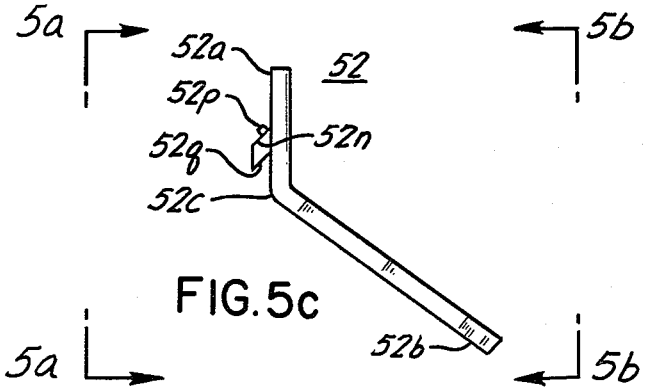
FIG. 5*c* shows an end elevational view of another one of the inner handle portions of the handle assemblies of FIGS. 1 and 2.

Outer handle portion 51 is a substantially V-shaped, one-piece member adapted to be interfitted with inner handle portion 52, which is shown best in FIGS. 5*a* through 5*c* and is comprised of portions 52*a* and 52*b* integrally joined along an edge or vertex 52*c*, in the manner shown best in FIG. 5*c* so as to form an obtuse angle therebetween. Inner handle portion 52, in a manner substantially similar to that of inner handle portion 42, is provided with a substantially oval-shaped outer perimeter 52*d* and a substantially oval-shaped central opening 52*e*, shown best in FIGS. 5*a* and 5*b*. A plurality of openings 52*f* are provided for receiving and interfitting with either the aforesaid threaded fastening members (not shown) utilized with the outer handle portion embodiment 41 of FIGS. 3*a* through 3*c* or are alternatively adapted to receive the projections 41*k* of the handle embodiment 41', shown in FIG. 3*d*.

The upper portion of inner handle part 52 is provided with a pair of substantially C-shaped projections 52*g*, 52*g* each having a central portion 52*h* and a pair of upwardly-extending integral arms 52*j*–52*k*. The upper ends of arms 52*j*–52*k* are each provided with a sloping surface 52*m*–52*n*. The undercut surface 52*g* of projection portion 52*h* forms a diagonally-aligned or sloping surface 52*p* aligned substantially parallel to the surfaces 52*m*–52*n*, as shown best in FIG. 5*c*.

A second pair of projections 52*p* are positioned slightly above and yet partially surrounded by the associated C-shaped projections 52*g*–52*g*. Projection pairs 52*g*-52*g* and 52*p*-52*p* cooperate with the openings 42*g*-42*g* and recesses 42*m*-42*m* provided in inner handle portion 42 in a manner shown best by the developmental views of FIGS. 6*a*–6*c*. Since each of the cooperating opening 42*g* and projection arrangements 52*g* function in substantially the identical manner, only one such cooperating projection assembly 52*g* and opening 42*g* will be described herein for purposes of brevity.

Figure 6A:
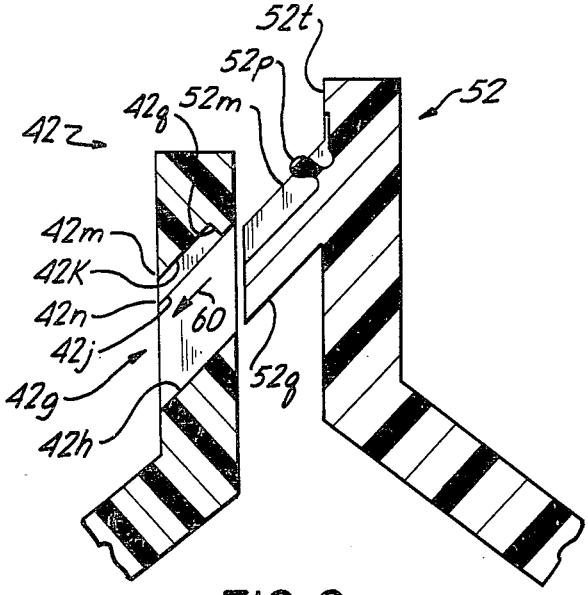
FIGS. 6*a*, 6*b* and 6*c* show partially sectionalized, fragmentary developmental views of the interfitted portions of the inner handle portions of FIGS. 4*c* and 5*c*, which Figures are useful in explaining the manner in which the inner handle portions are interfitted and releasably secured to one another.
Figure 6B:
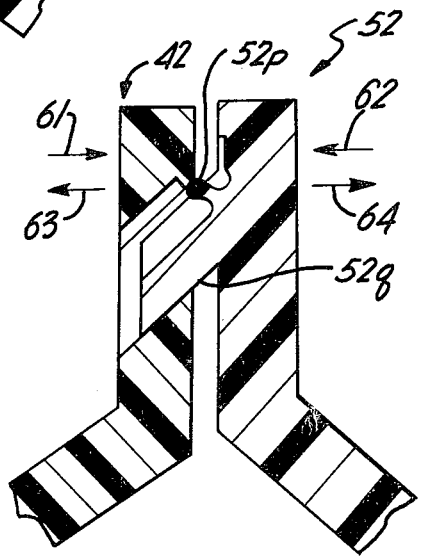
Figure 6C:
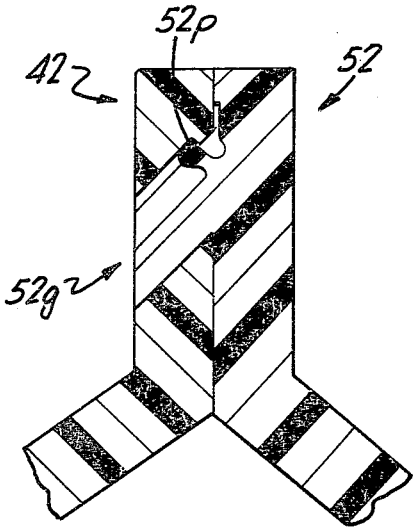

Assuming the handle halves 40 and 50 are disassembled and it is desired to bring the handle halves 40 and 50 into locking engagement, the handle halves 40 and 50 are moved toward one another to bring the projection 52*g* into alignment with the slot 42*j*, in the manner shown in FIG. 6*a*. With the handle halves 40 and 50 in this position, inner handle portion 52 is moved in the direction shown by arrow 60 so as to cause projection 52*g* to be inserted into opening 42*g*. As inner handle portions 42 and 52 are moved closer together, they arrive at the relative position shown best in FIG. 6*b*, with projection 52*p* resting against the portion of surface 42*j* just above shoulder 42*q*. Inner handle portions 42 and 52 are then brought into locking engagement as shown in FIG. 6*c* merely by exerting a light squeezing pressure upon members 42 and 52 in order to provide for the application of forces exerted upon members 42 and 52 in the directions shown by arrows 61 and 62 of FIG. 6*b*.

The engagement of sloping surface 52*q* with sloping surface 42*h* enables projection 52*g* to function as a guiding surface, causing projection 52*p* to snap into position against shoulder 42*q*.

As long as the handle halves 40 and 50 are lightly squeezed together by the hand when carrying the luggage piece 10, the handle halves 40 and 50 remain in the interfitted and locked position assuming an inverted V-shaped configuration. In the event that it is desired to separate the handle halves 40 and 50, the luggage piece 10 need only be set down upon a supporting surface, the handle assembly released and the handle halves 40 and 50 pulled apart by exerting only light pulling forces, for example, in the directions shown by arrows 63 and 64 of FIG. 6*b* to cause projection 52*p* to be snapped out of the locking position shown in FIG. 6*c* and to assume the released position shown in FIG. 6*b*, whereupon the handle halves 40 and 50 need only be drawn apart to gain access to the interior of the luggage piece 11 by opening side fasteners 18 and 20.

Figure 7A:
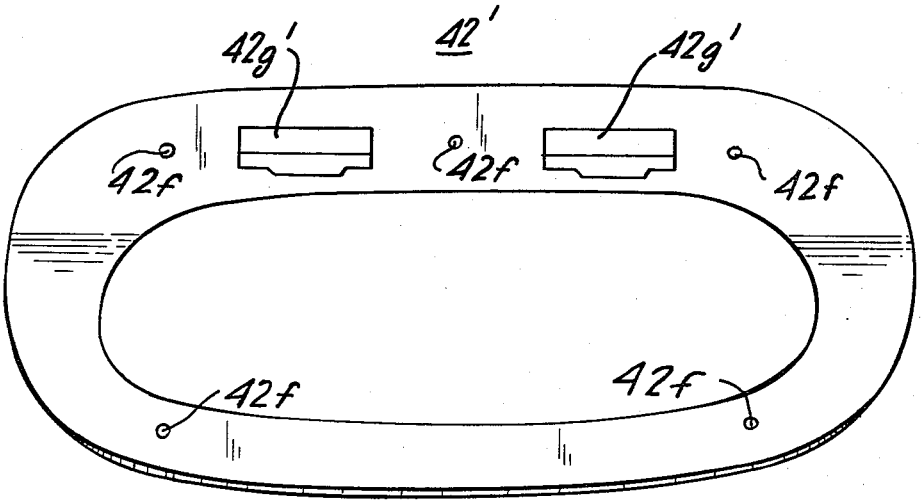
FIG. 7*a* shows a plan view of an alternative embodiment of the inner handle portion of FIG. 4*a*.
Figure 7B:
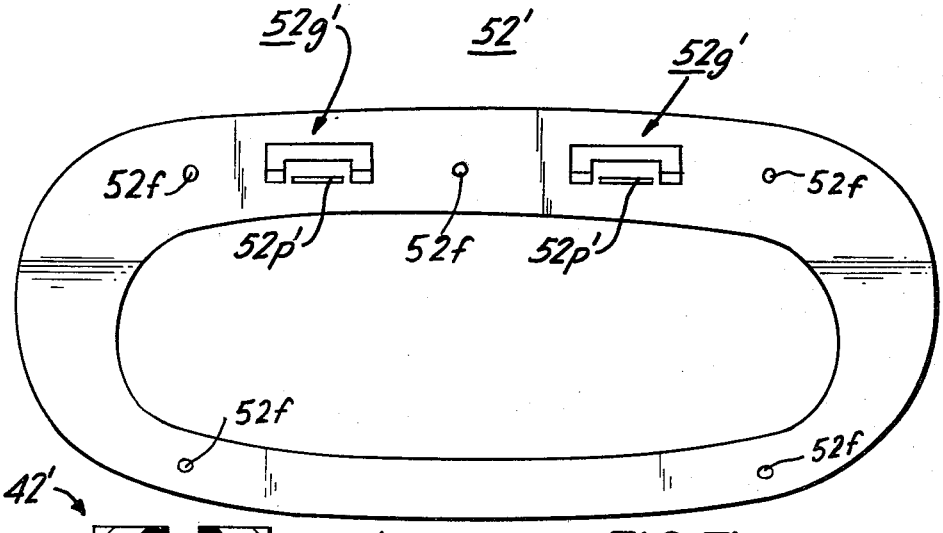
FIG. 7*b* shows a plan view of an alternative embodiment of the inner handle portion of FIG. 5*a*.

FIGS. 7*a* and 7*b* show alternative embodiments 42' and 52' of the inner handle portions 42 and 52. The views of FIGS. 7*a* and 7*b* are substantially identical to the views of FIGS. 4*a* and 5*a*, except that the openings 42*g'*, 42*g'* and the projection assemblies 52*g'*, 52*g'*, and 52*p'*, 52*p'* are oriented "upside down", i.e., rotated 180° relative to the associated openings 42*g*, 42*g*, and projections 52*g*, 52*g*, and 52*p*, 52*p*.

Figure 7C:
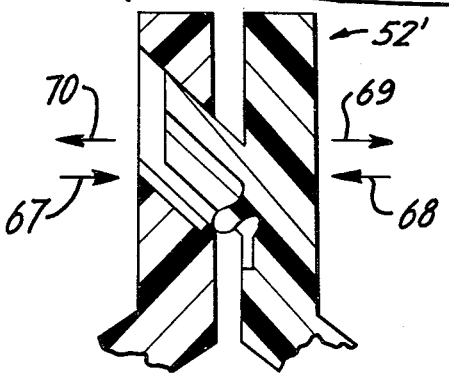
FIG. 7*c* shows a partially sectionalized, fragmentary view of the manner in which the inner handle portions of FIGS. 7*a* and 7*b* are joined together.

The locking effect between members 42' and 52' is substantially identical to that obtained in FIG. 6*c*, except that the closing forces and opening forces are exerted below the respective projections 52*g'* and openings 42*g'*, the forces exerted to snapfittingly lock the inner handle portions 42', 52' to one another being shown by arrows 67 and 68 and the forces provided for separating the inner handle portions 42' and 52' being represented by the arrows 69 and 70 of FIG. 7*c*. In the embodiment of FIG. 7*c*, the forces exerted by inner handle portions 42' and 52' due to the weight of the luggage piece 10 (see FIG. 1) being carried serve to cooperate with the light squeezing force exerted by the person carrying the luggage piece 10 to retain the handle halves 40 and 50 in the interfitted and locked position.

The V-shaped configurations of the inner and outer handle portions 41, 42 and 51, 52 of each handle half 40, 50 serve to permanently retain each flap 11*a* and 12*a* in substantially the same V-shaped configuration, whereupon the portion of each flap 11*a* and 12*a* in the region of the upper halves of each inner handle portion 52*a* and 42*a* are substantially parallel to one another, thereby preventing the flaps 11*a* and 12*a* from exerting any undesirable forces upon the handle assembly 30 which would tend to pull the handle halves 40 and 50 out of locking engagement.

A latitude of modification, change, and substitution is intended in the foregoing disclosure, and in some instances, some features of the invention will be employed without a corresponding use of other features. For example, flaps 11*a* and 12*a* may be made of plastic. In such case, each flap, such as flap 11*a* and its associated handle portions 41 and 42 may be molded in one operation, forming an integral assembly of members 11*a*, 41 and 42. The mold may be textured, for example, to simulate a leather finish on the surface of flap 11*a*. Accordingly, it is appropriate that the appended claims be construed broadly and in a manner consistent with the spirit and scope of the invention herein.

What is claimed is:

1. Portable carrying means comprising a carrying portion having a pair of supple flaps integral with said carrying portion, each flap having an opening;

a handle assembly comprising first and second handle sub-assemblies each being integrally joined to one of said flaps;

each handle sub-assembly having an opening aligned with the opening in the associated flap;

said first and second sub-assemblies including first and second locking means respectively for releasably locking said first and second sub-assemblies to one another;

said first locking means comprising a guidance opening having a locking recess; and said second locking means comprising an alignment projection for insertion into said guidance opening and a locking projection for releasable engagement with said locking recess.

2. The carrying means of claim 1 wherein said guidance opening comprises a pair of opposing sloping surfaces on opposite sides of said opening; and said alignment projection projecting diagonally downward and away from said second sub-assembly for insertion into said guidance opening.

3. The carrying means of claim 2 wherein said alignment projection has a substantially C-shaped configuration comprised of a central portion and upwardly extending arms; and said locking projection being positioned between the arms of said alignment projection.

4. The carrying means of claim 3 wherein said locking projection has an enlarged free end.

5. The carrying means of claim 4 wherein said enlarged free end has a substantially rounded shape.

6. The carrying means of claim 2 wherein said locking recess is formed in one of said sloping surfaces.

7. The carrying means of claim 1 wherein said guidance opening comprises a pair of opposing sloping surfaces on opposite sides of said opening; and said alignment projection projecting diagonally upward from said second sub-assembly for insertion into said guidance opening.

8. The carrying means of claim 1 wherein each flap and its associated handle sub-assembly are molded from a plastic material.

9. Portable carrying means comprising a carrying portion having a pair of supple flaps integral with said carrying portion, each having an opening;

a handle assembly comprising first and second handle sub-assemblies each being integrally joined to one of said flaps;

each handle sub-assembly having an opening aligned with the opening in the associated flap;

said first and second sub-assemblies including first and second locking means respectively for releasably locking said first and second sub-assemblies to one another;

said first and second sub-assemblies each comprising outer and inner handle portions positioned on opposite sides of said associated flap; and joining means for joining said inner and outer handle portions.

10. The portable carrying means of claim 9 wherein each of said sub-assemblies have an upper locking portion and an integral lower portion extending downward and away from said locking portion; and said first and second sub-assemblies and said flaps forming an inverted Y-shaped handle assembly in the interlocked position to prevent said flaps from exerting a force upon said handle assembly which would otherwise tend to pull said first and second subassemblies apart.

11. The carrying means of claim 9 wherein said joining means comprises projections integrally formed in each outer handle portion;

each inner handle portion and the associated flap having openings for receiving said projections; and said projections being fused to the inner handle portion by ultra-sonic bonding.

12. The carrying means of claim 9 wherein the upper portion of each outer handle portion has a curved convex surface to collectively provide a gripping portion to prevent any discomfort to the carrier's hand.

13. The carrrying means of claim 9 wherein said carrying portion has a pair of side surface portions on opposite sides of said carrying portion; and each of said flaps being an integral part of an associated one of said side surfaces.

14. The carrying means of claim 9 wherein said carrying portion comprises first and second hollow carrying halves open along one end;

slide fastener means for joining the adjacent edges of said first and second carrying halves to form a closed hollow carrying portion, the opposite sides of said first and second carrying halves remote from said edges, each having a major side surface;

each of said flaps being integral with an associated one of said major side surfaces; and said flaps being adapted to extend over at least a portion of the edges of said carrying halves joined by said slide fastener means.

15. The carrying means of claim 9 wherein said joining means comprises projections integrally formed in each outer handle portion;

each inner handle portion and the associated flap having openings for receiving said projections; and the ends of said projections being enlarged and having slots to permit said projections to be collapsed when inserted into an associated opening and thereafter resume their original position when said enlarged ends clear said opening, said enlarged ends locking said outer handle portion to said inner handle portion.

* * * * *

UNITED STATES PATENT AND TRADEMARK OFFICE

CERTIFICATE OF CORRECTION

PATENT NO. : 4,298,104

DATED : November 3, 1981

INVENTOR(S) : Henry Leong

It is certified that error appears in the above—identified patent and that said Letters Patent is hereby corrected as shown below:

Column 5, line 14, change "41g" to --41q--.

Signed and Sealed this

*First* Day of *June 1982*

[SEAL]

*Attest:*

GERALD J. MOSSINGHOFF

*Attesting Officer*

*Commissioner of Patents and Trademarks*